United States Patent [19]

Murphy

[11] Patent Number: 4,836,120

[45] Date of Patent: Jun. 6, 1989

[54] SELF-RIGHTING WATERBORNE CRAFT

[76] Inventor: William Murphy, 2142 N. Magnolia, Chicago, Ill. 60614

[21] Appl. No.: 662,131

[22] Filed: Oct. 18, 1984

[51] Int. Cl.[4] ..... B63B 1/00

[52] U.S. Cl. ..... 114/61; 114/125; 114/39.1

[58] Field of Search ..... 114/61, 39, 125, 68, 114/343, 345, 121

[56] References Cited

U.S. PATENT DOCUMENTS

| | | | |
|---|---|---|---|
| 3,585,955 | 6/1971 | Cella . | |
| 3,865,061 | 2/1975 | Newman | 114/90 |
| 3,954,077 | 5/1976 | Piat-Marchand . | |
| 4,102,287 | 7/1978 | Ferris . | |
| 4,223,621 | 9/1980 | Berger . | |
| 4,227,474 | 10/1980 | Ullrich . | |
| 4,416,639 | 11/1983 | Gillmer . | |

OTHER PUBLICATIONS

High Speed Sailing, p. 83 (1979).

"The Righting of a Tremolino Trimaran", Aaron Wright, pp. 179–203.

"A Real-Life 36-Foot Self-Righting Catamaran", Multihulls, Nov./Dec. 1979, pp. 31–35.

Ayrs 95, Dec. 1982, drawing (Tonga 28 Crew-Rightable).

"Latitude 38", vol. 43, Jan. 1984, 3 page article by Patricia Miller.

*Primary Examiner*—Joseph F. Peters, Jr.

*Assistant Examiner*—Clifford T. Bartz

*Attorney, Agent, or Firm*—Nixon & Vanderhye

[57] ABSTRACT

Disclosed is a system for displacing the center of buoyancy from the center of gravity in a capsized craft and maintain the displacement until the craft is substantially re-righted. Buoyancy is provided such that the craft floats high in the water when inverted. Flooding ports and venting ports are opened to allow at least one hull to partially flood, eliminating the buoyancy previously provided by the hull. Elimination of this buoyancy causes a displacement in the overall center of buoyancy which begins a pitch, or roll about the craft's longitudinal axis, which continues until the center of gravity is located directly under the center of buoyancy and the craft is substantially re-righted, although some pumping out of water in the flooded hull will be necessary.

10 Claims, 4 Drawing Sheets

SELF-RIGHTING WATERBORNE CRAFT

BACKGROUND OF THE INVENTION

1. Field of the Invention

The present invention relates generally to the rerighting of a capsized craft and more specifically to a method and apparatus for self-righting a multihulled waterborne craft.

2. Discussion of the Prior Art

Multihulled craft are extremely stable seagoing platforms and have been utilized for centuries for extended ocean passages (see for example the Poynesian travels to Hawaii in crude but seaworthy catamaran craft). However, the separation of the hulls which provide the multi-hull stability provide similar stability when the craft is capsized (upside down), making it extremely difficult to re-right the craft. Whereas the typical lead keel monohull sailboat will re-right itself due to the location of the ballast in the craft, the same is not true with multihulled craft because the ballast contained will not overcome the stabilizing effect of the multiple hulls when these hulls are uspside down and have a volume of air located thereunder.

Although a multi-hulled craft which has been capsized remains a very stable plarform and can be lived on or in for numerous weeks while awaiting rescue, it would be advantageous to be able to re-right the craft at sea effecting a self rescue for the occupants and the craft. There have been proposed a number of methods for re-righting capsized multiple hull vessel, many of which utilize the vessel's mast to provide leverage with which to overcome the stability imparted by the outrigger or buoyant hulls. Essentially a float is provided in the form of a life raft or other inflatable device which can be winched "down" to the top of the mast. The greater moment arm of a float at the end of the mast as opposed to the buoyancy of the hull displaced from the base of the mast provides a sufficient moment arm to rotate the craft approximately 90° and then by either floating or pumping out one of the buoyant hulls the remaining righting moment is provided to bring the boat to its normal condition. There are numerous variations upon the theme which uses the mast to provide an extremely long moment arm for self-righting of a multihull vessel. However, all of these methdos suffer from the simple defect that if the mast is no longer in place after capsize there will be no way for the craft to be righted. A review of actual capsizes proves that the mast is not always present or has been damaged to the extent that it cannot be used to provide the necessary overturning moment.

Another method makes the use of an A-frame or a guyed pole located near one end of the craft with a water bag suspended therefrom. As water is pumped into the water bag suspended just above the surface, the end of the boat on which the A-frame or pole is located is depressed into the water. As the bag is filled with water and the end of the boat is depressed, the A-frame or pole is winched up so as to keep the bag above the water's surface. This process will continue until the boat is pulled past the 90° point, at which point it continues to overturn until it is almost upright and any remaining water inside the craft can be bailed or drained out. Variations upon this theme require the flooding of a portion of the hull in a multi-hulled craft of external flotation devices in the form of a life raft or dingy to provide an additional overturning moment.

Common to all of these methods is the requirement of a considerable amount of crew effort which may not be available after capsize and in difficult sea conditions. Further, these methods are dependent upon a number of mechanical devices which could fail or be lost during capsize, rendering the entire system inoperative. For these reasons, the "real world" usefulness of these methods is doubtful. There are additional righting methods for multihulled craft in which a watertight bulkhead is provided in the craft and, after a forward compartment is flooded, an air bag is inflated amid ships under the craft and is winched in a more forward position as the craft begins to right. A variation upon this method is that disclosed in U.S. Pat. No. 4,227,474 to Ullrich which discloses a watertight cabin at the aft portion of a catamaran with floodable chambers in the bow. The bow chambers are flooded and the craft rotates approximately 130° from the initial capsized position. At this point compressed air is utilized to force water out of the floodable bow chambers completing the re-reghting and additional water in the main hulls is then pumped out by the crew. Problems with both of the above methods arise in that it requires that the integrity of a watertight compartment (either the aft cabin in Ullrich or the air bags) be maintained and in addition a compressed air source must be maintained in a fully charged state.

Thus, all previous self-righting systems required that the mast be intact and structurally sound after capsize, requires intense crew efforts after capsize, or depends upon watertight compartments or inflatable bags in combination with compressed air inflating mechanisms in order to effect the righting action.

In an article entitled "Capsize Recovery For Trimarans" by Derek Kelsall published in the November/-December 1982 issue of *MultiHulls* magazine, there is disclosed the use of extremely large air bags on which to float almost the entire weight of a trimaran, such that when one outer hull is submerged the crew assisting can lift the mast and provide enogh of a righting moment to re-right a trimaran without the main hull becoming flooded. Of course this requires a substantial additional structure in the form of air bags, and their inflating mechanisms as well as crew aid in positioning the air bags, lifting the mast, etc. While such a re-righiting system is certainly feasible, it is still dependent upon the crew being healthy and available, the air bags and their inflation system being intact and and operable and would seem to require substantial effort to initiate the operation.

SUMMARY OF THE INVENTION

It is an object of the present invention to provide a self-righting waterborne craft which can re-right after capsize with little or no crew effort.

It is a further object of the present invention to provide a multihull craft which is capable of self-righting from capsize with no additional crew effort.

It is a further object of the present invention to provide a self-righting multihull craft which does not require that the mast remain in place after capsize, does not require that the integrity of watertight cabins be maintained, does not require compressed air systems for pumping out floodable compartments and does not require any compliated mechanical apparatus.

The above and other objects of the present invention are achieved by providing a self-righting waterborne craft with at least one floodable hull, a port system for flooding the hull when the craft is floating inverted and a buoyancy device located substantially amidships in an upper portion of the hull, for displacing the center of buoyancy of the craft below and to one side of the center of gravity of the craft when the craft is floating inverted with the at least one hull at least partially flooded.

It a further preferred embodiment of the present invention, the buoyancy device is located between ports which are located displaced from the center of buoyancy in the direction of rotation during self-righting. A flooding port permits water to enter the floodable hull, while the venting port permits air located in the floodable hull to be released allowing the center of buoyancy to be displaced away from the center of gravity such that full rotation can occur.

BRIEF DESCRIPTION OF THE DRAWINGS

A more complete appreciation of the invention, and many of the attendant advantages thereof, will be readily apparent as the same becomes better understood by reference to the accompanying drawings, wherein.

DETAIL DESCRIPTION OF PREFERRED EMBODIMENTS

Figure 1:
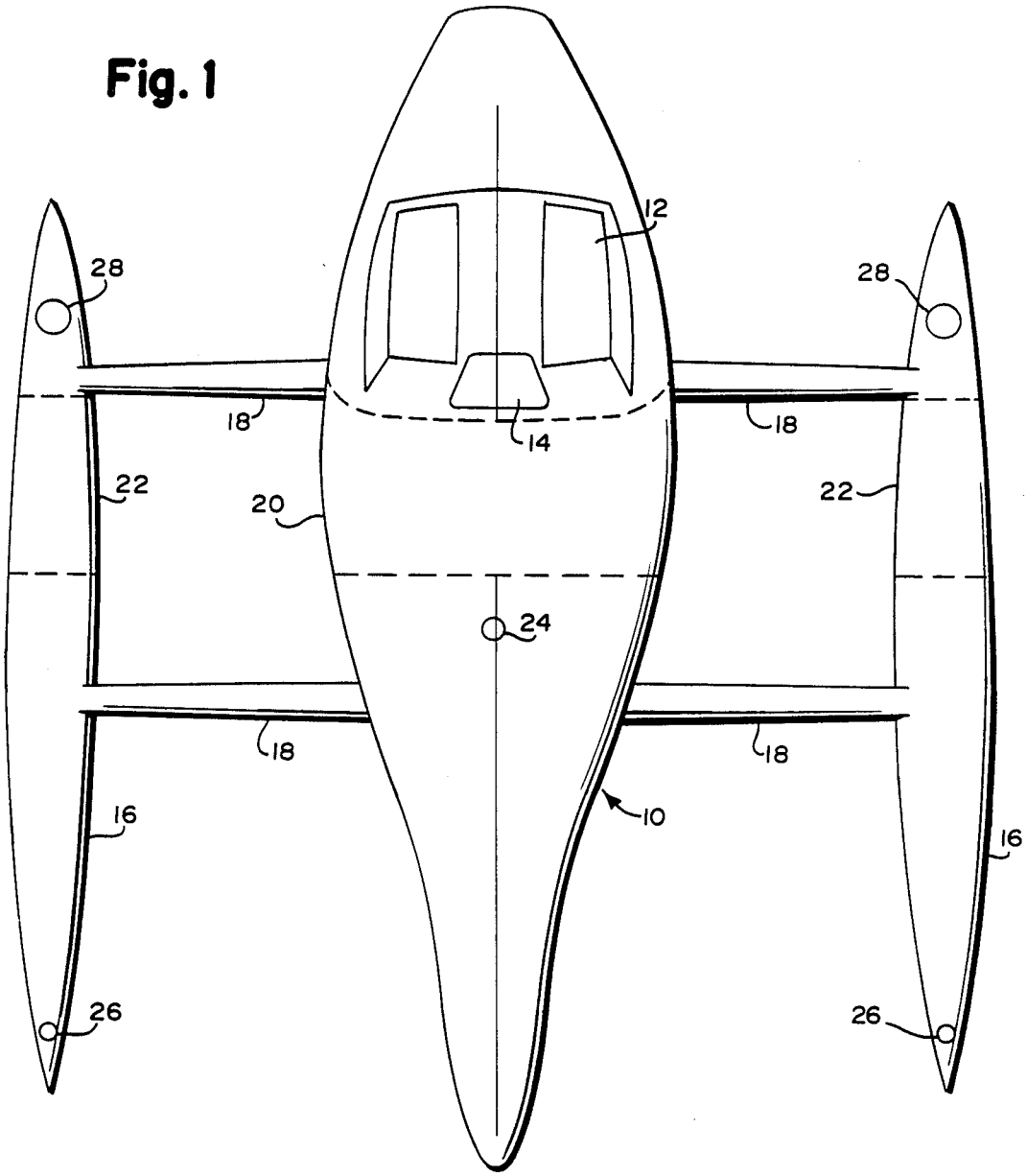
FIG. 1 is a top view illustrating a trimaran craft implementing the present invention.

Referring now to the drawings wherein like reference numerals indicate similar elements throughout the several views, FIG. 1 illustrates a trimaran to which the present invention has been applied. It is understood that the present invention could be applied to single or multiple hulled crafts and the trimaran embodiment discussed is merely exemplary. The main hull 10 or "vaka" as known in the trade, has a cockpit area 12 and a hatch 14 leading into the inner cabin area of the main hull. Outer hulls 16 or "amas" are connected to the main hull by connecting beams 18 or "akas," Inside the main hull and at a substantially amidships location is a buoyancy module 20 as shown in phantom lines. Although this bouyancy module could be a permanently sealed compartment, in a preferred embodiment, it is an area of lightweight foam which not only provides thermal insulation but also prevents entry of water into the volume occupied by the foam. A simple closed cell foam molded or fastened into place in the craft will suffice. Alternatively, an inflatable chamber internal to the craft, which is inflated prior to sailing, could be utilized. Since inflation of such a chamber only displaces air, there would be no need for the compressed air tanks which are needed to inflate chambers in which water is displaced. Therefore, a buoyancy module could be a permanently sealed chamber, permanetly sealed but with an operable inspection port a pre-sailing inflatable chamber, or foam flotation. The reference to FIG. 2 and FIG. 3 will further illustrate the positioning of the main hull bouyancy module 20. Additionally, outer hulls 16 can contain auxiliary buoyancy modules 22 if desired. In fact in some embodiments it may be desirable to have bouyancy modules located only in the outer hulls with none located in the main hull 10.

A means for flooding the main hull when it is inverted in the water is provided through ports in the hull, for example, flooding port 24, and through air leaking around hatch 14 in this embodiment. A venting port could be located in the stern of the craft if the craft design so required. Outer hulls 16 also include means for flooding the outer hulls when inverted and comprise forward flooding ports 26 and aft venting ports 28. While it is important that these ports be open during the self-righting process, normally these ports would be kept closed and watertight to prevent seepage of rain or spray into the main or outer hulls. In a preferred embodiment, and with the exception of the buoyancy modules, it is anticipated that all hulls are in fluid communication throughout their length. In other words, air and/or water could pass from the forward port to the aft port in either the main hull or the outer hulls. It may also be desirable to utilize the rearmost connecting beam 18 as a buoyancy module such that it is filled with foam or suitably sealed while having the forwardmost connecting beam vented to the outer hulls.

Figure 4A:
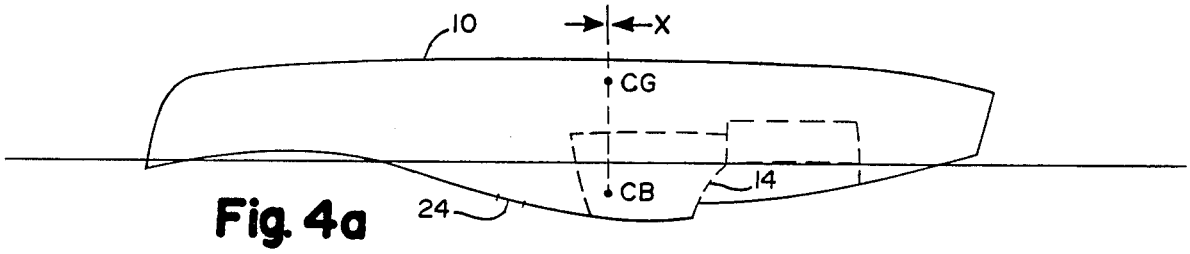
FIGS. 4*a*–4*e* are side views illustrating self-righting of the trimaran shown in FIGS. 1–3 in accordance with the present invention.

By reference to FIGS. 4*a*–4*e* an understanding of how the self-righting occurs in accordance with the present invention can be understood. First however a brief discussion of the physics of self-righting may facilitate understanding of this process. In a waterborne craft, a stable craft is one which tends to resume its initial position when displaced away from that initial position. By looking at FIG. 2, one can see that in a trimaran craft, the center of gravity is often located well above the center of buoyancy of the main hull which would normally make for a very unstable craft. However, as the craft is displaced away from the position shown in FIG. 2, i. e., when one outer hull is depressed into the water, that hull generates substantial additional buoyancy causing the overall center of buoyancy of the craft to move toward the depressed hull. Becausee of tipping of the main hull, the center of buoyancy moves towards the depressed hull. Because the center of gravity has not move, the center of buoyancy exerts a righting moment tending to lift the depressed hull, moving the hull back towards its original position. Thus, a trimaran has extreme positive stability in its normal floating configuration. Unfortunately, many multihulled craft exhibit the same positive stability when capsized into an inverted position, as shown in FIG. 4*a*. Because the outer hulls contain a bubble of air in each hull, the "roll" or side-to-side staility of the craft is very similar to that discussed with reference to FIG. 2 and the same principles would apply. Furthermore, the "pitch" or fore and aft stability of the craft also comes from the air located within the main and outer hulls but to a lesser degree. In FIG. 4 if the nose of the craft were depressed further into the water, by virtue of the air in that hull, water would be displaced generating bouyancy at the nose of the boat moving the overall center of buoyancy forward. Consequently the nose would tend to pitch up, tending to right the craft towards the stable position shown in FIG. 4*a*, in which the center of buoyancy is directly under the center of gravity.

As previously noted in various prior art methods of self-righting which utilize the mast of the boat and a flotation device on the mast, the center of buoyancy is moved far enough away from the center of gravity in order to overcome the stability of the boat in the invert position. In other methods, heavy weight in the form of water filled bags are added to the bow of the boat in order to keep the overall center of gravity forward of the center of buoyancy causing the nose of the boat to pitch downward, and ultimately, right itself.

In the present invention, as in the Ullrich patent, the center of buoyancy is displaced from the center of gravity by removing the buoyant force generated at one end of the craft, in the present embodiment, the nose. However Ullrich requires an extremely large buoyant chamber in the form of a sealed cabin in the aft portion of the boat, whereas the present invention utilizes a buoyancy module located in more of an amidships position. The advantages of this location will be realized subsequently. Now a brief discussion of the entire self-righting procedure in accordance with the present invention will be discussed.

Beginning in FIG. 4*a* it can be seen that the main hull 10 is floating in a stable manner with X (the horizontal displacement between the center of gravity and the center of buoyancy) equal to 0. The occupants of the craft in FIG. 4*a* would most probably wait until the storm or squall which capsized them had ceased and the seas had calmed to some degree before beginning the self-righting process. However, to initiate the process, flooding port 24 would be opened and, because it is located below the inverted water line, water would begin to flow into main hull 10. In the event outer hulls 16 also were being used to effect the self-righting, flooding ports 26 would also be opened. However for clarity of understanding the outer hulls are not shown in FIGS. 4–4*e*, although as previously noted, these could be included in the self-righting process or indeed it may be desirable to use only the outer hulls to effect self-righting without the inclusion of the buoyancy module and other aspects in main hull 10.

Water entering main hull 10 forces air within this main hull to exit through the main hatch 14 or a stern vent (not shown). Incidentially, it is the difficulty of sealing such large access hatches that creates some difficulty in sealing the entire stern cabin, as required in the Ullrich patent.

Figure 4B:
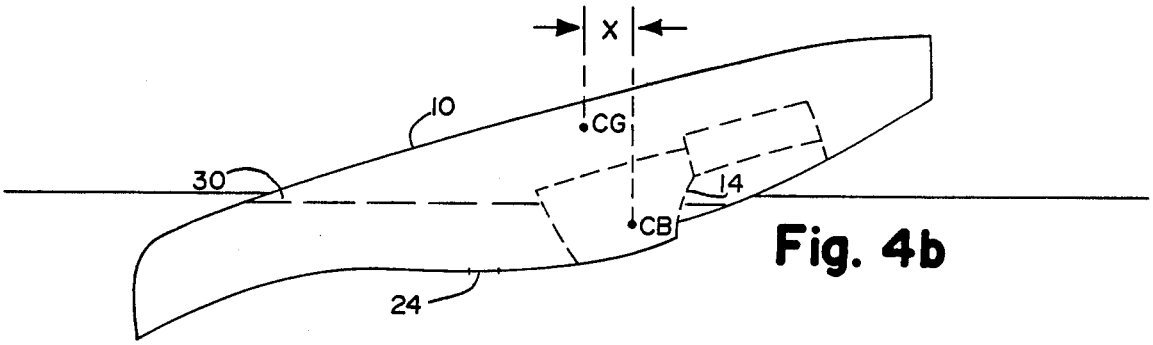
Figure 4C:
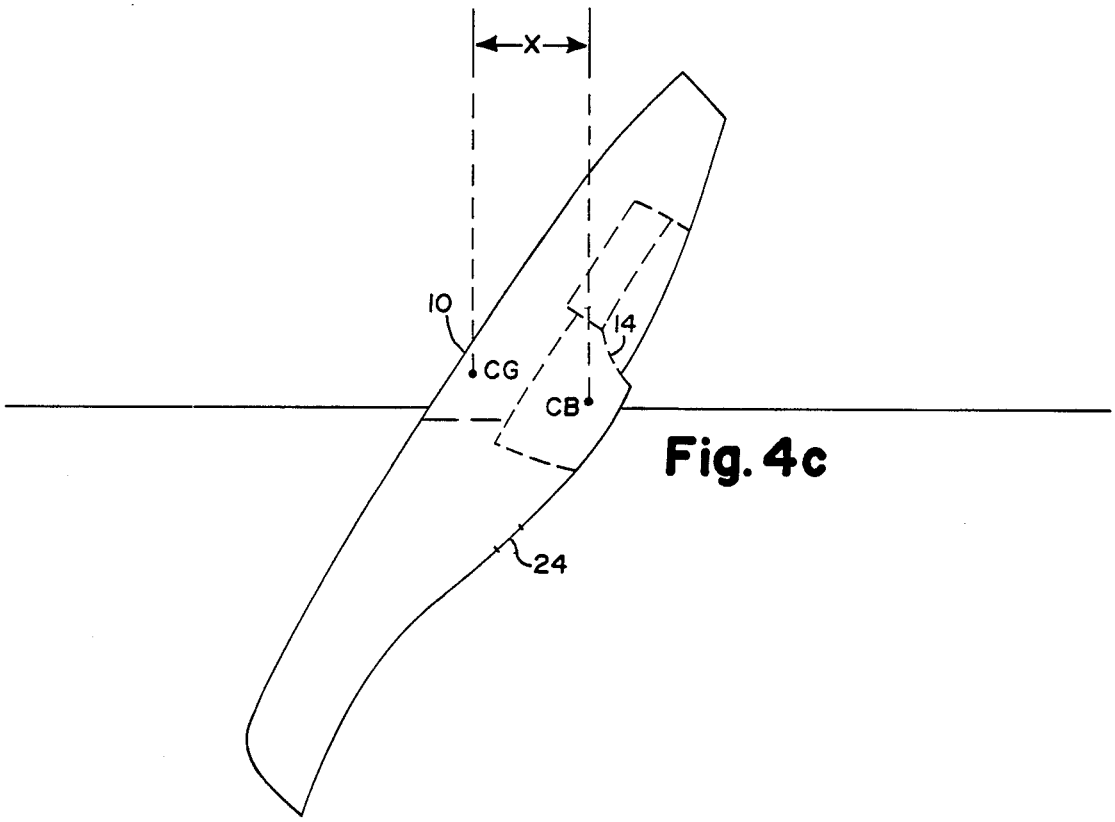

As water floods into the main hull in FIG. 4*b* (as shown by the dotted line 30), the center of buoyancy moves aft because less buoyancy is being provided by the nose of the craft in pitch. The craft begins rotating about its transverse axis with the nose continuing to pitch down as water continues coming in through port 24, as shown in FIG. 4*c*. The greater the distance X between the center of gravity and center of buoyancy, the faster the rotation in pitch will be. However due to the possibility of the mast still being attached and sails being in place, there is a substantial hydrodyamic drag to the pitching motion which will make this a relatively slow process.

Figure 2:
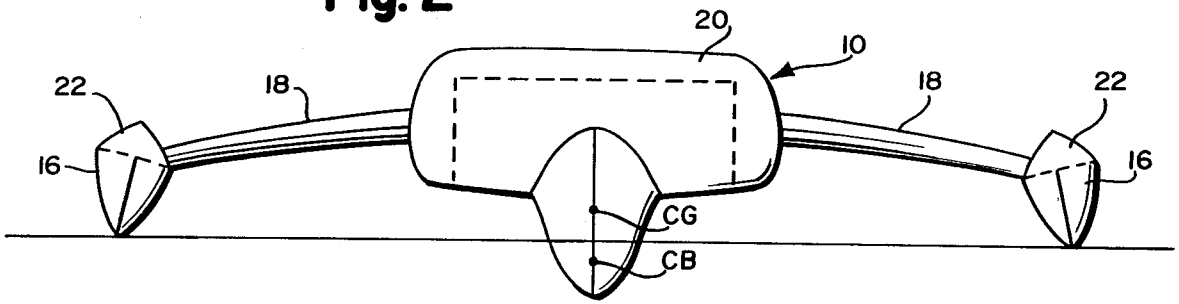
FIG. 2 is a front view of the trimaran hull shown in FIG. 1.
Figure 3:
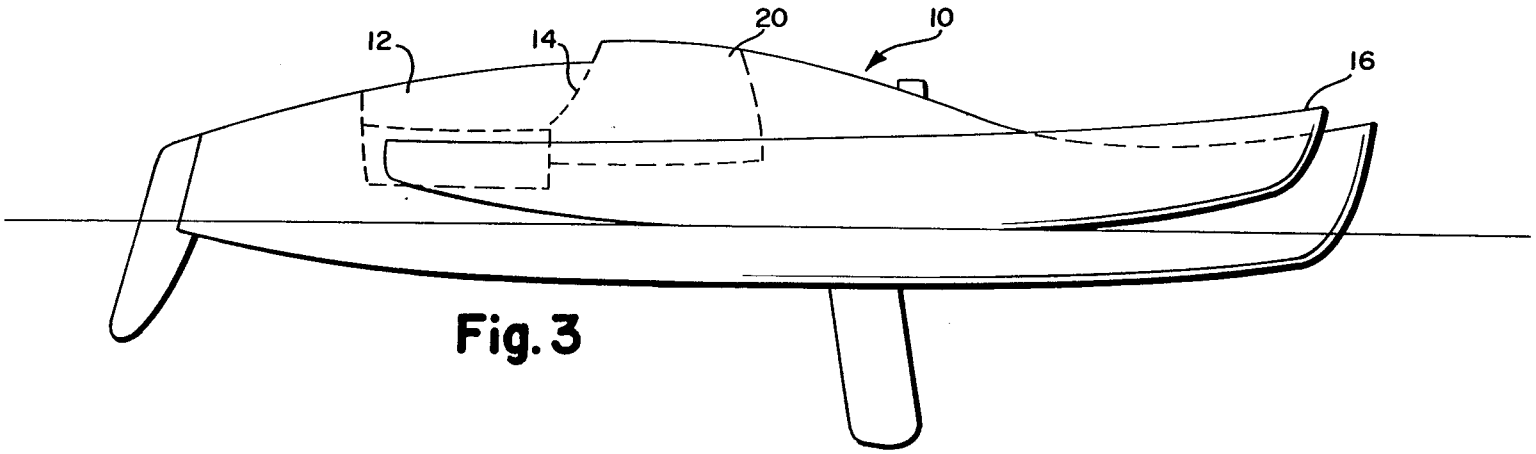
FIG. 3 is a side view of the trimaran hull shown in FIGS. 1 and 2.

It can be seen in Fiures 4*c* and 4*d* that even as the craft reaches and passes the vertical position a substantial distance differential remains between the center of buoyancy and center of gravity causing the pitch process to continue. This substantial difference is caused in large part because of the location of the buoyancy module in an upper portion of the cabin top as shown in FIG. 2. This provides a high degree of flotation in the upper portion of the main hull while auxiliary engine, water tanks, anchor chain and other heavy items will generally be stowed relatively low in the main hull maintaining a low center of gravity and aiding in the self-righting process.

Figure 4D:
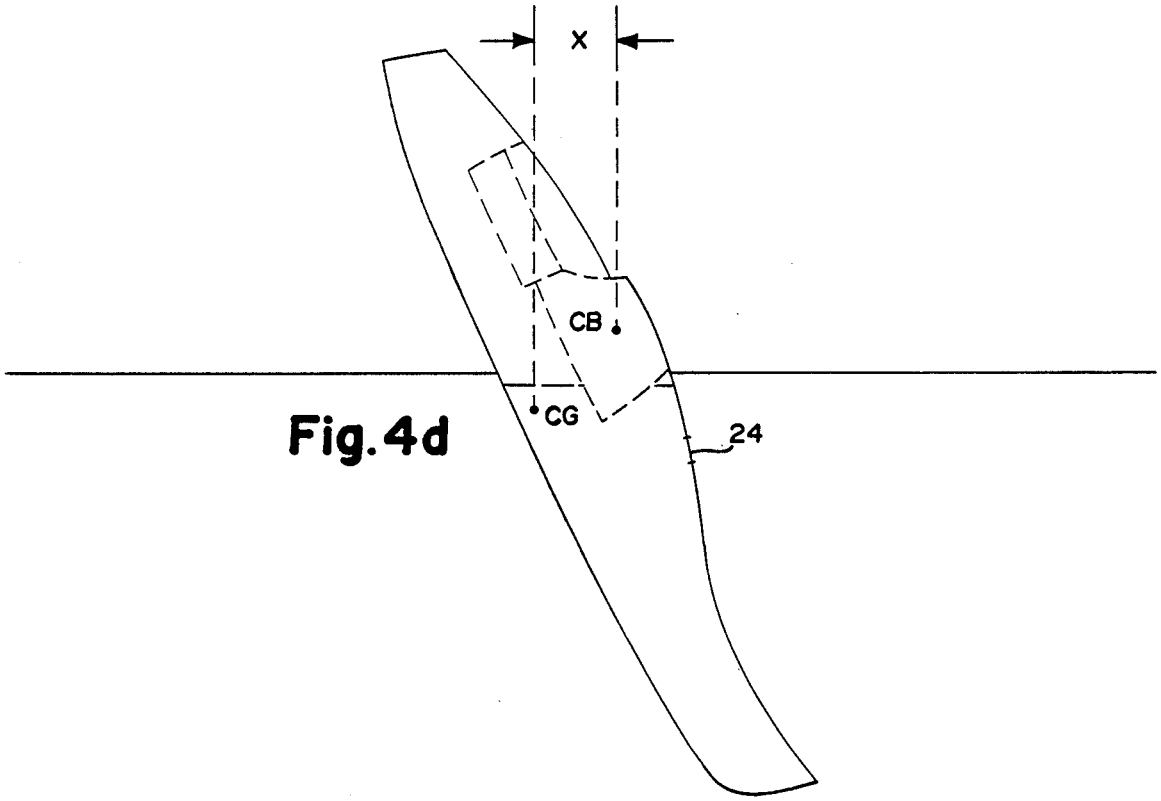

The rotation about the craft's transverse axis will continue from FIG. 4*d* through FIG. 4*e* until the center of gravity is once again vertically aligned with the center of buoyancy altohough at this point it will be below the center of buoyancy. The craft will once again be stable in the water but in an essentially righted position. The crew can then close flooding port 24 (and outer hull flooding ports 26 if used) and pump the water remaining in the hull out to bring the hull to the floating condition shown in FIG. 2. In the event the outer hulls 16 were used in the self-righting process, water contained in the hulls would be pumped out through the aft venting ports 28.

Figure 4E:
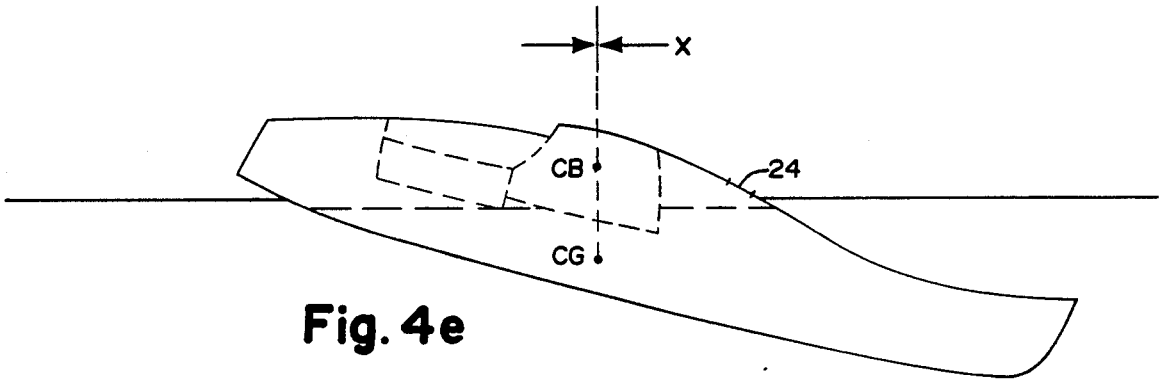

It can be seen in FIG. 4*e* that because of the location of the center of buoyancy in the craft, no special compressed air systems or other such devices are needed in order to bring the craft to an essentialy upright position. It can also be seen that the cockpit sides and the cabin top are substantially above the water line at which the craft floats when awash providing enoguh free board to facilitate pump-out at the crew's leisure. Thus, even one crew member could pump out the entire craft over a short period of time whether by using bailing buckets, manual pumps or electric or gasoline powered pumps as taught in the Ullrich patent.

In a preferred embodiment, the opening and closing of ports 24, 26, 28, and any main hull aft port if used, would be controlled by the crew so as so choose at which point self-righting begins. This allows for the crew to stabilize their situation immediately upon capsize and, only when they have decided conditions are right, to initiate the self-righting procedure. However in some instances it may be desirable to have the craft automatically self-right in which case the ports would be open all the time and the self-righting procedure would begin immediately upon capsize of the craft. The only action required by the crew would be the closing of the forward flooding ports after self-righting has occurred in order that the main and outer hulls can be pumped out.

Although the preferred embodiment of the present invention involves rotation about the transverse axis (a pitching motion), the same selft-righting procedures and structure could be applied to rotation about a longitudinal axis, i.e., a rolling self-righting action. In this instance both the forward and aft connecting beams 18 would be in communication between the outer hulls and the main hull and the opening of the fore and aft ports on the outer hulls would allow one hull to flood, while air located in that hull could pass through the cross-beam towards the other hull and out the similar ports located in he opposite outer hull. It may be necessary to have auxiliary ports in the bottom of the outer hulls in order to sufficiently vent air from the hull to be submerged so that the center of buoyancy is sufficiently displaced away from that submerging hull so as to cause the multi-hull craft to roll about its longitudinal axis. Once the rolling has occured, the ports on the submerged outer hull would be closed and water contained in those hulls pumped out through hoses contained in one or more connecting beams. After the outer hulls were pumped out, the main hull could be emptied of any water contained therein.

The advantages of the present system over that of Ullrich are quite apparent in that there is no necessity for a complex compressed air system with floodable but sealed compartments which can then be evacuated of water by supplying them with compressed air. Further, if the last occupant to leave the rear cabin in Ullrich fails to completely and water tightly seal the aft cabin or if there are air leaks around any of the windows or fittings contained in that cabin, the integrity of the cabin will be threatened compromising the ability to right the craft at a later point in time.

In the present invention, the use of fixed in-place foam or buoyancy chambers eliminates the possiblity that the crew can compromise the self-righting ability of the craft through an inadvertent action or through non action. Although it is possible that inflatable bags or the like could be utilized to provide the appropriate buoyancy in the present invention, they require inflation prior to sailing and are subject to damage during the initial capsize period. While the use of such presailing inflated bags are contemplated with the present invention, the preference is towards a fixed buoyancy system. The Kelsall trimaran recovery system anticipates the use of extremely large air bags external to the craft capable of floating the entire overturned boat and re-righting the craft essentially keeping all water out of the main hull during the righting procedure. The present system, even with air bags located internally, does not anticipate keeping water out of the craft and rather uses water in the craft to reduce the righting moment necessary to overcome the weight of the mast, sails, etc. in rerighting the craft.

In view of the above discussion, many modifications and variations of the present invention will be obvious to those of ordinary skill in the art. The precise location of the amidships buoyancy means will vary from craft to craft depending upon its center of gravity when awash versus its center of gravity when upside down. Further, other than foam or hollow chamber buoyancy systems are known and under certain conditions may be acceptable. In the present invention, it is desirable that the main and/or outer hulls which are floodable be permitted to communicate throughout their length in order to permit sufficient flooding to provide the center of gravity movement necessary for self-righting. In order to facilitate this flooding, it is important that there be some means for venting the hulls on either side of the buoyancy means such that water can enter the hull through one port and air located in the hull leave through the other port, while the hull pivots essentially around the bouyancy means. Thus, within the above parameters and constraints, the application of this technique to a wide variety of muli-hull craft is anticipated. In fact there may be even single hulled craft which are configured so as to be relatively stable in the inverted position and the present invention could advantageously be applied to such single hulled craft as well. Therefore, and in view of the above teachings, many modifications and applications of the invention will be obvious to those of ordinary skill in the art. The invention is not limited to the specific examples and embodiments expressed herein, and is limited only in accordance with the appended claims.

The embodiments of the invention in which an exclusive property or privilege is claimed are definied as follows:

1. A self-righting waterborne craft having a center of gravity, said craft being capable of floating when awash, comprising:

at least one hull;

means for partially floooding said at least one hull when said craft is floating inverted; and buoyancy means, located substantially amidships in an upper portion of and internal to the hull, for displacing the center of buoyancy of said craft below and to one side of the center of gravity of said craft when said craft is inverted with said at least one hull at least partially flooded, wherein said means for partially flooding and said buoyancy means comprise the sole means for rotating said hull to a non-inverted position at which water at least partially flooding said one hull can be removed from said hull.

2. The waterborne craft in accordance with claim 1, wherein said means for partially flooding said at least one hull comprises:

at least a venting port means for venting said at least one hull; and at least a flooding port means for partially flooding said at least one hull, said port means being spaced apart from each other and said buoyancy means located substantially between said at least two port means.

3. A self-righting waterborne craft in accordance with claim 1, wherein said at least one hull has two ends and each of said ends is in fluid communication with the other of said ends.

4. A self-righting waterborne craft having a center of gravity, said craft being capable of floating when awash, comprising:

at least one hull;

means for partially flooding said at least one hull when said craft is floating inverted; and buoyancy means, comprising one of a permanently sealed chamber, a pre-sailing inflatable chamber, and a quantity of foam, for displacing the center of buoyancy of said craft below and to one side of the center of gravity of said craft when said craft is inverted with said at least one hull at least partially flooded, wherein said means for partially flooding and said buoyancy means comprises the sole means for rotating said hull to a non-inverted position at which water at least partially flooding said one hull can be removed from said hull.

5. The self-righting waterborne craft of claim 1 or 4, wherein said craft is a three-hulled trimaran.

6. The self-righting trimaran of claim 5, wherein said means for flooding said at least one hull comprises:

at least a venting port means for venting said at least one hull; and at least a flooding port means for partially flooding said at least one hull, said port means being spaced apart from each other and said buoyancy means located substantially between said at least two port means.

7. The self-righting trimaran of claim 6, wherein said at least one hull comprises the center hull of said trimaran and said center hull has two ends, each of said ends is in fluid communication with the other of said ends.

8. The self-righting trimaran of claim 6, wherein said at least one hull comprises all three hulls of the trimaran and each of said three hulls has two ends, each of said two ends is in fluid communication with the other of said two ends.

9. A method of self-righting a waterborne craft having a center of gravity, said craft being capable of floating when awash, and including at least one hull, a means for partially flooding said at least one hull when said craft is floating inverted; and buoyancy means, located substantially amidships in an upper portion of and internal to the hull, for displacing the center of buoyancy of said craft below and to one side of the center of gravity of said craft when said craft is inverted with said at least one hull at least partially flooded, said method comprising the steps of:

opening said partially flooding means to begin at least partially flooding said at least one hull;

allowing said at least one hull to partially flood such that the craft begins to roll towards said hull as said hull sinks deeper in the water, said rolling continuing until said craft in non-inverted; and pumping out any water contained within said waterborne craft.

10. A method of self-righting a waterborne craft according to claim 9, wherein said partially flooding means includes at least one flooding port which is located below the water level when the craft is floating non-inverted, before said pumping port in the partially flooding means which is located below the water level when the craft is non-inverted.

* * * * *